US011592204B2

(12) United States Patent
Agbley

(10) Patent No.: US 11,592,204 B2
(45) Date of Patent: Feb. 28, 2023

(54) GLASS INTEGRATED FAN ASSEMBLY

(71) Applicant: Justice Raymond Agbley, Lake Forest Park, WA (US)

(72) Inventor: Justice Raymond Agbley, Lake Forest Park, WA (US)

( * ) Notice: Subject to any disclaimer, the term of this patent is extended or adjusted under 35 U.S.C. 154(b) by 224 days.

(21) Appl. No.: 17/089,780

(22) Filed: Nov. 5, 2020

(65) Prior Publication Data

US 2022/0136731 A1 May 5, 2022

(51) Int. Cl.

| | |
|---|---|
| ***F24F 11/56*** | (2018.01) |
| ***F24F 13/12*** | (2006.01) |
| ***F24F 7/013*** | (2006.01) |
| *F24F 13/14* | (2006.01) |

(52) U.S. Cl.

CPC ..... *F24F 13/12* (2013.01); *F24F 7/013* (2013.01); *F24F 11/56* (2018.01); *F24F 2013/1433* (2013.01)

(58) Field of Classification Search

CPC .. F24F 13/12; F24F 11/56; F24F 7/013; F24F 2013/1433; F24F 1/027; F24F 1/031; F24F 5/0075; F24F 13/18

USPC ..... 454/324

See application file for complete search history.

(56) References Cited

U.S. PATENT DOCUMENTS

| | | | | |
|---|---|---|---|---|
| 2,011,419 | A * | 8/1935 | Ross | F24F 7/013 454/208 |
| 4,226,049 | A | 10/1980 | Maust | |
| D318,526 | S | 7/1991 | Chaney | |
| 5,105,868 | A | 4/1992 | Riise | |
| 5,365,706 | A | 11/1994 | Peter | |
| 6,579,169 | B1 * | 6/2003 | Demark | F24F 7/013 454/200 |
| 10,012,408 | B1 | 7/2018 | Crittenden | |
| 2004/0007000 | A1 * | 1/2004 | Takeda | F24F 1/0087 62/264 |
| 2010/0197214 | A1 | 8/2010 | Geremia, Sr. | |
| 2017/0097164 | A1 * | 4/2017 | Chang | E06B 7/10 |
| 2019/0001249 | A1 | 1/2019 | Hong | |

FOREIGN PATENT DOCUMENTS

| | | |
|---|---|---|
| WO | WO2010091179 | 8/2010 |

* cited by examiner

*Primary Examiner* — Avinash A Savani
*Assistant Examiner* — Ryan L Faulkner

(57) ABSTRACT

A glass integrated fan assembly for enabling a closed sliding door to ventilate a structure includes a door module or window module, which comprises a frame and a glass pane. The glass pane is engaged to the frame. The frame is positionable in an opening in a structure and can engage the structure so that the glass pane closes the opening. The glass pane has an aperture positioned therein. A fan unit is positioned in the aperture and is engaged to the glass pane. The fan unit can be used to ventilate an interior space of the structure. A panel is slidably engaged to the glass pane. The panel is selectively slidable from an open configuration, wherein the panel is positioned adjacent to the aperture, to a closed configuration, wherein the panel closes the aperture.

12 Claims, 5 Drawing Sheets

GLASS INTEGRATED FAN ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ventilation assemblies and more particularly pertains to a new ventilation assembly for enabling a closed sliding door to ventilate a structure.

(2) Description of Related Art Including Information Disclosed Under 37 CFR 1.97 and 1.98

The prior art relates to ventilation assemblies, in particular ventilation assemblies for sliding doors. Prior art ventilation assemblies may comprise screened windows positioned within glass of the sliding door and fans that are positionable in a gap resulting from partial opening of the sliding door.

BRIEF SUMMARY OF THE INVENTION

An embodiment of the disclosure meets the needs presented above by generally comprising a door module or window module, which comprises a frame and a glass pane. The glass pane is engaged to the frame. The frame is configured to be positioned in an opening in a structure and to engage the structure so that the glass pane closes the opening. The glass pane has an aperture positioned therein. A fan unit is positioned in the aperture and is engaged to the glass pane. The fan unit thus is configured to ventilate an interior space of the structure.

A panel is slidably engaged to the glass pane. The panel is selectively slidable from an open configuration, wherein the panel is positioned adjacent to the aperture, to a closed configuration, wherein the panel closes the aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
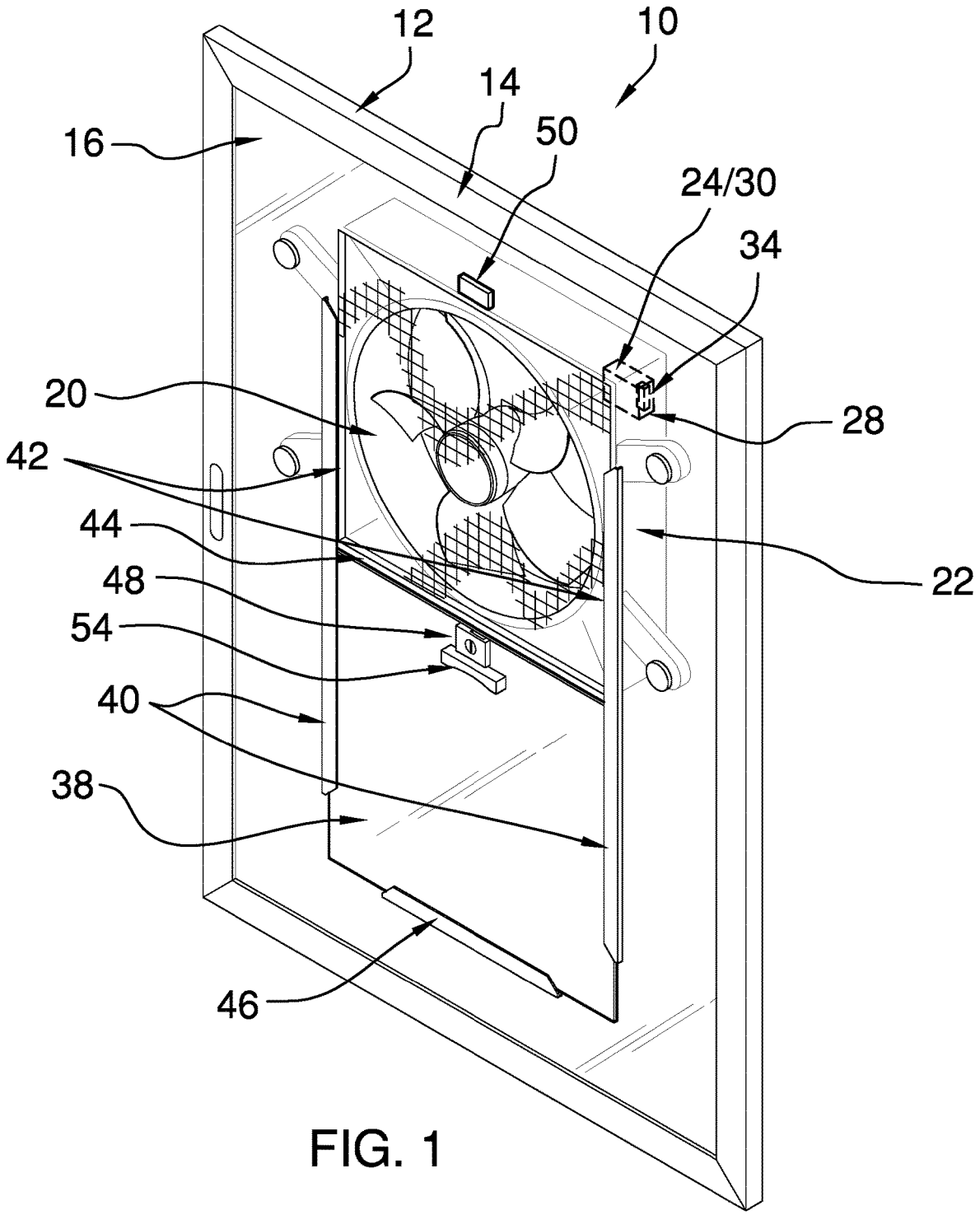
FIG. 1 is an isometric perspective view of a glass integrated fan assembly according to an embodiment of the disclosure.

With reference now to the drawings, and in particular to FIGS. 1 through 5 thereof, a new ventilation assembly embodying the principles and concepts of an embodiment of the disclosure and generally designated by the reference numeral 10 will be described.

Figure 2:
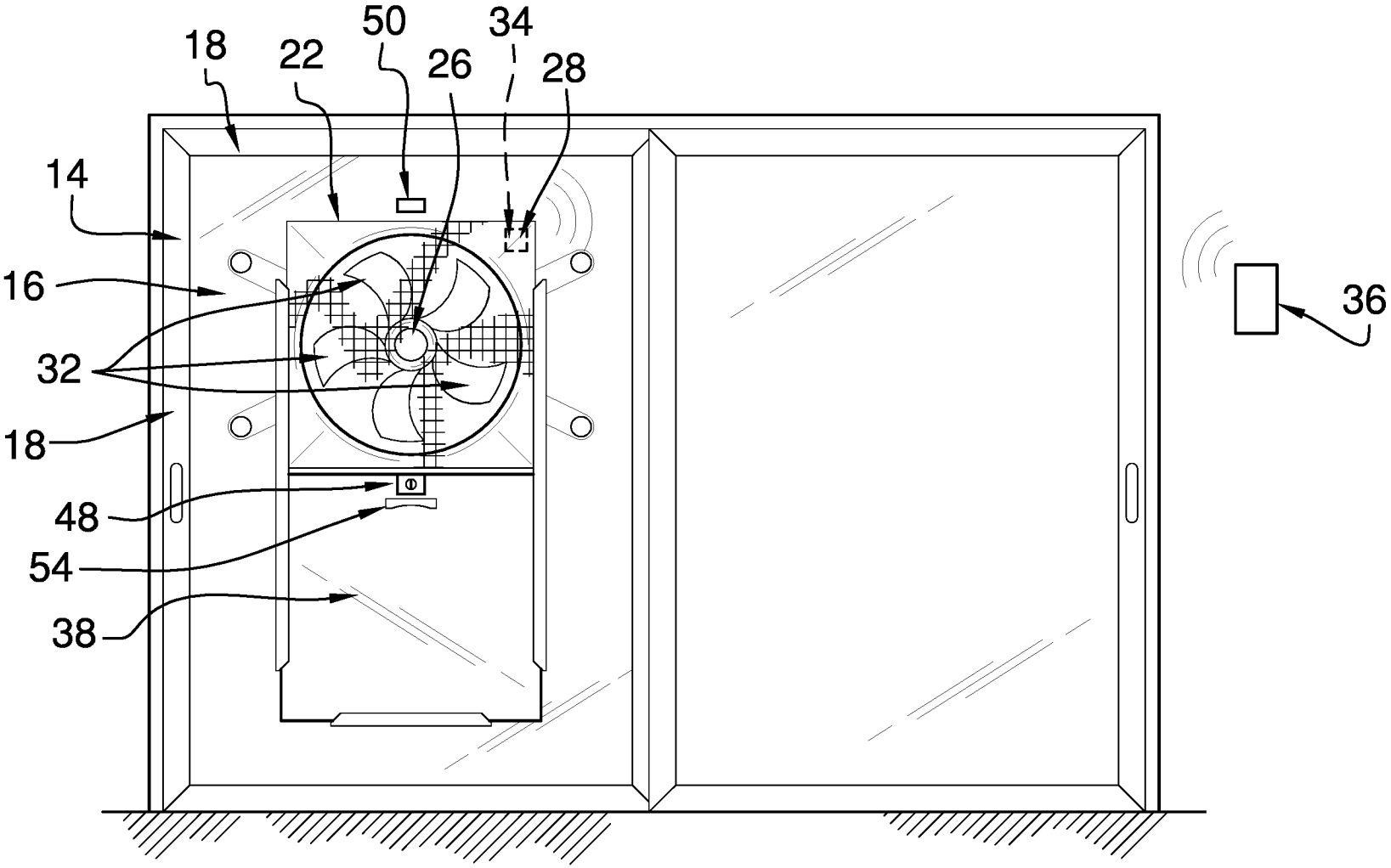
FIG. 2 is a front view of an embodiment of the disclosure.
Figure 3:
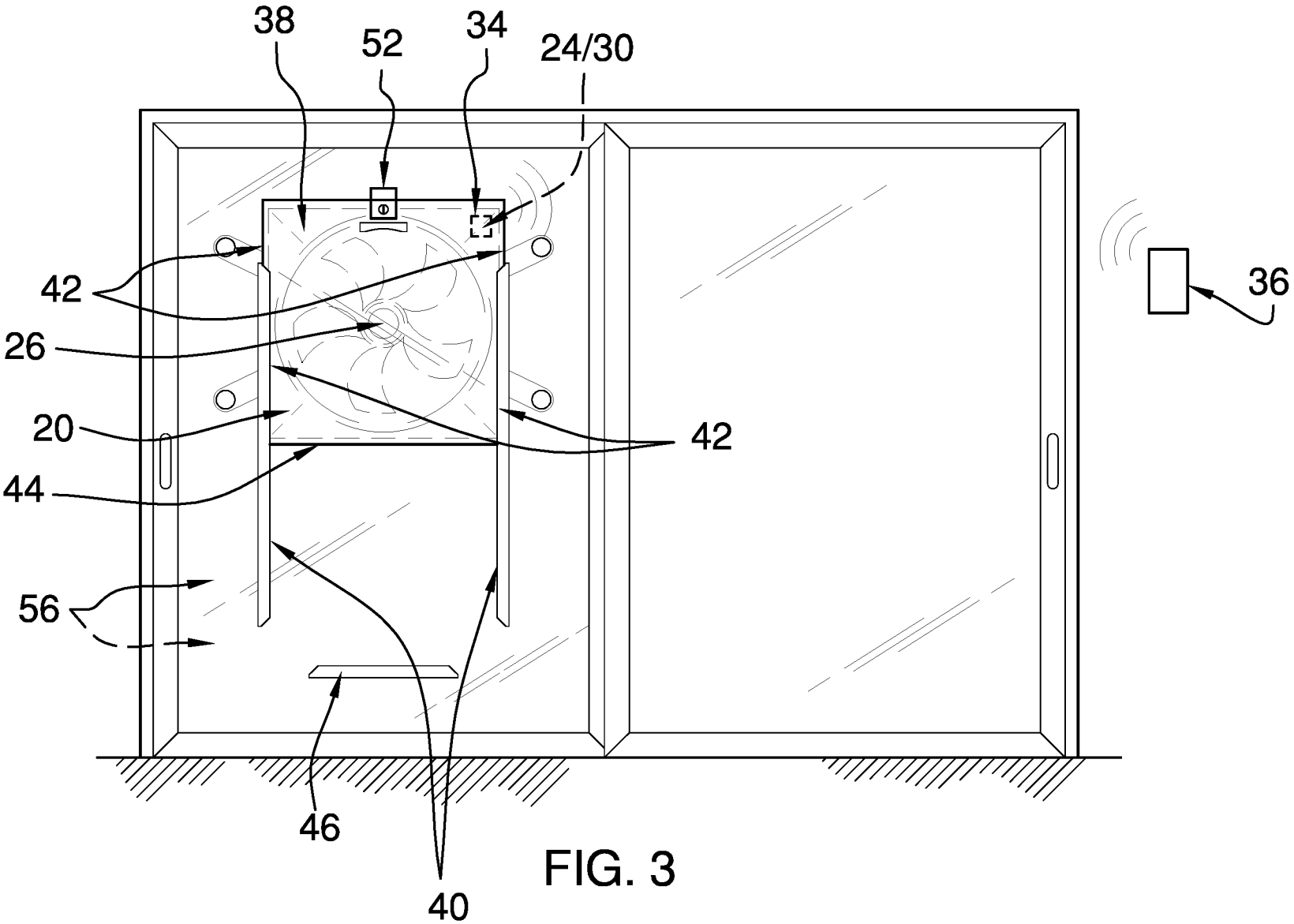
FIG. 3 is a front view of an embodiment of the disclosure.
Figure 4:
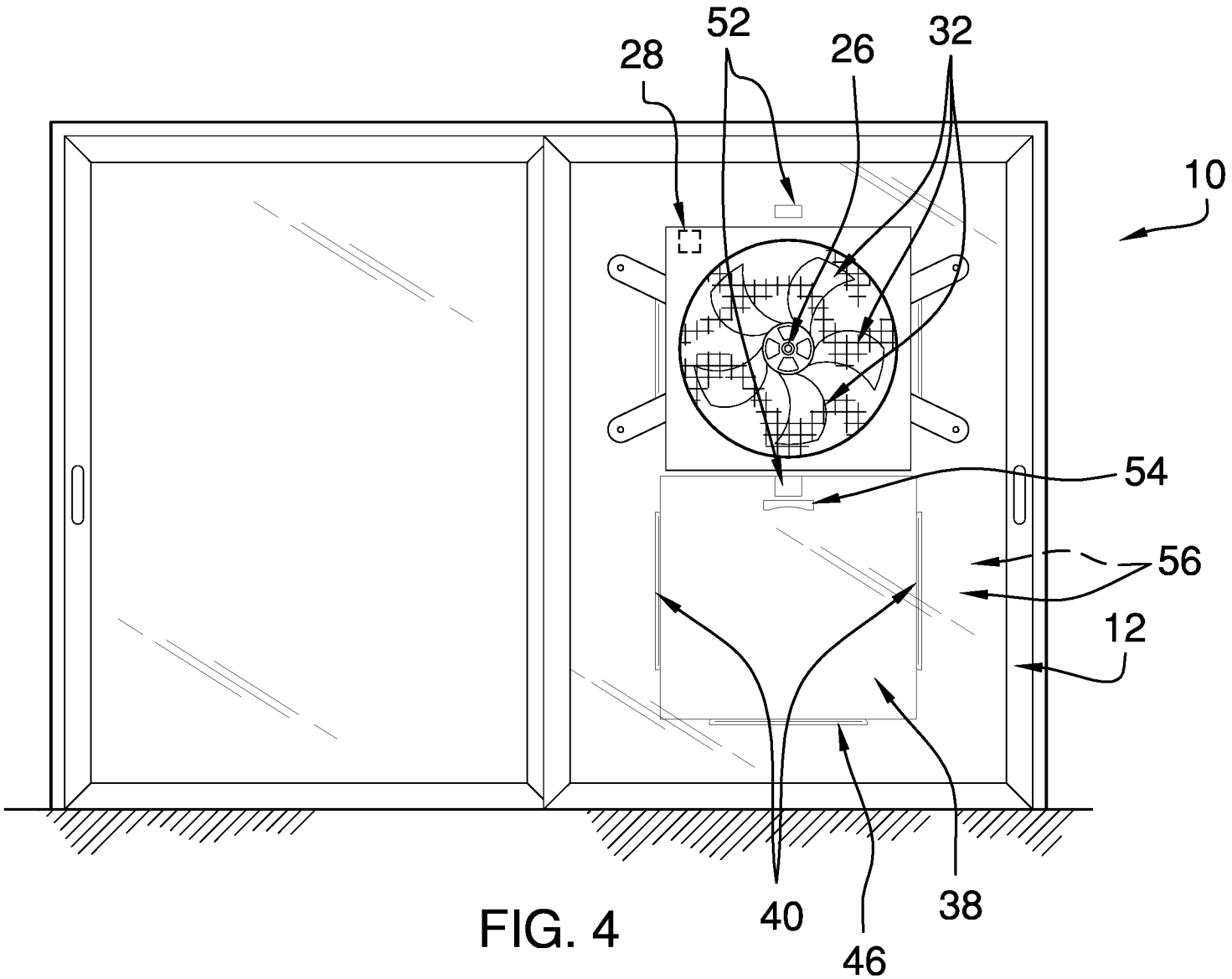
FIG. 4 is a rear view of an embodiment of the disclosure.

As best illustrated in FIGS. 1 through 5, the glass integrated fan assembly 10 generally comprises a door module 12 or window module (not shown), which in turn comprises a frame 14 and a glass pane 16. The door module 12 may comprises a glass door 18 or a solid door (not shown). The glass door 18 may be slidably openable and closable, as shown in FIGS. 2-4.

Figure 5:
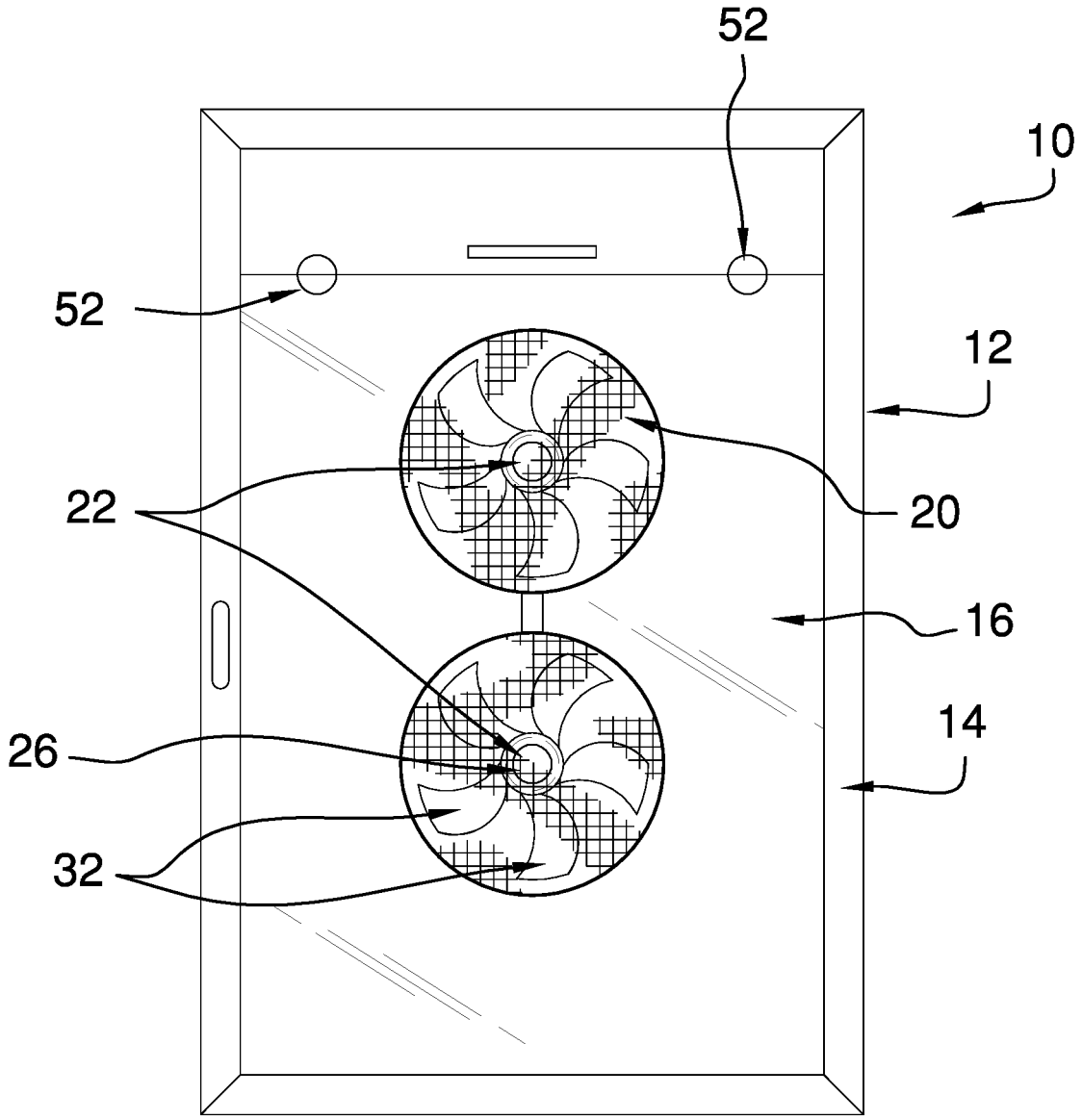
FIG. 5 is a front view of an alternative embodiment of the disclosure.

The glass pane 16 is engaged to the frame 14. The frame 14 is configured to be positioned in an opening, such as an opening for a door or a window, in a structure and to engage the structure so that the glass pane 16 closes the opening. The glass pane 16 has an aperture 20 positioned therein. The aperture 20 may be squarely shaped, as shown in FIG. 1, or circularly shaped, as shown in FIG. 5.

A fan unit 22 is positioned in the aperture 20 and is engaged to the glass pane 16. The fan unit 22 thus is configured to ventilate an interior space of the structure. The fan unit 22 may be rectangularly box shaped, as shown in FIG. 1, or round, as shown in FIG. 5. A shown in FIG. 5, the fan unit 22 may comprise a pair of fan units 22. The fan units 22 of the pair of fan units 22 can operate in the same or opposing directions.

The fan unit 22 comprises a power module 24, a motor 26, and a controller 28. The power module 24 comprises a power cord (not shown) or a battery 30. The motor 26, which has a plurality of blades 32 engaged thereto, is operationally engaged to the power module 24. The power module 24 is positioned to selectively power the motor 26 to turn the blades 32. The controller 28 is operationally engaged to the power module 24 and the motor 26 and thus is positioned to selectively engage the motor 26 to the power module 24 to supply power thereto and to control a rotational speed thereof. The present invention also anticipates a perimeter frame (not shown) engaged to the glass pane 16 and extending circumferentially around the aperture 20, with the fan unit 22 being engaged to the perimeter frame.

The controller 28 comprises a receiver 34. A remote control 36 is operationally engaged to the controller 28 via the receiver 34. The remote control 36 is positioned to selectively signal the controller 28 to supply power to the motor 26 and to control the rotational speed thereof.

A panel 38 is slidably engaged to the glass pane 16. The panel 38 is selectively slidable from an open configuration, wherein the panel 38 is positioned adjacent to the aperture 20, to a closed configuration, wherein the panel 38 closes the aperture 20. The panel 38 and the fan unit 22 each are positioned on a respective opposed face 56 of the glass pane 16. The panel 38 may comprise glass so as to not impede viewing through the glass pane 16 when the panel 38 is in the open configuration.

A pair of side rails 40 is engaged to the glass pane 16. Each side rail 40 extends along a respective opposed side 42 of the aperture 20 and extends past a lower end 44 of the aperture 20. The panel 38 is slidably engaged to the pair of side rails 40 so that the side rails 40 are positioned to guide the panel 38 as the panel 38 is slid between the open configuration and the closed configuration. A bottom rail 46 engaged to the glass pane 16 in parallel with the lower end 44 of the aperture 20 is positioned for seating of the panel 38 in the open configuration.

A first fastener 48 is engaged to the panel 38. A second fastener 50, which is complementary to the first fastener 48, is engaged to the glass pane 16. The second fastener 50 is positioned to selectively engage the first fastener 48 with the panel 38 in the closed configuration so that the panel 38 is fixedly positioned in the closed configuration. The second fastener 50 and the first fastener 48 comprise a locking unit 52, which is keyed, as shown in FIG. 3. The panel 38 thus can be secured in the closed configuration by an authorized user.

A handle 54 engaged to the panel 38 is configured to engage a hand of a user so that the user is positioned to slide the panel 38 between the open configuration and the closed configuration.

In use, when ventilation of the interior space is desired, the panel 38 is slid to the open configuration and the fan unit 22 is engaged. When ventilation is not required, the fan unit 22 is turned off and the panel 38 is slid to the closed configuration and secured in place with the locking unit 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A glass integrated fan assembly comprising:

a door module or window module comprising a frame and a glass pane, the glass pane being engaged to the frame, the frame being configured for positioning in an opening in a structure and for engaging the structure such that the glass pane closes the opening, the glass pane having an aperture positioned therein;

a fan unit positioned in the aperture and engaged to the glass pane, wherein the fan unit is configured for ventilating an interior space of the structure;

a panel slidably engaged to the glass pane, such that the panel is selectively slidable from an open configuration, wherein the panel is positioned adjacent to the aperture, to a closed configuration, wherein the panel closes the aperture;

a first fastener engaged to the panel; and a second fastener engaged to the glass pane, the second fastener being complementary to the first fastener, such that the second fastener is positioned for selectively engaging the first fastener with the panel in the closed configuration, such that the panel is fixedly positioned in the closed configuration.

2. The glass integrated fan assembly of claim 1, wherein the door module comprises a glass door.

3. The glass integrated fan assembly of claim 2, wherein the glass door is slidably openable and closable.

4. The glass integrated fan assembly of claim 1, wherein:

the aperture is squarely shaped; and the fan unit is rectangularly box shaped.

5. The glass integrated fan assembly of claim 1, wherein the fan unit comprises:

a power module, the power module comprising a power cord or a battery;

a motor operationally engaged to the power module;

a plurality of blades engaged to the motor, such that the power module is positioned for selectively powering the motor for turning the blades; and a controller operationally engaged to the power module and the motor, such that the controller is positioned for selectively engaging the motor to the power module for supplying power thereto and for controlling a rotational speed thereof.

6. The glass integrated fan assembly of claim 1, further including:

the controller comprising a receiver; and a remote control operationally engaged to the controller via the receiver, such that the remote control is positioned for selectively signaling the controller for supplying power to the motor and for controlling a rotational speed thereof.

7. The glass integrated fan assembly of claim 1, wherein the panel and the fan unit each are positioned on a respective opposed face of the glass pane.

8. The glass integrated fan assembly of claim 1, further including:

a pair of side rails, each side rail being engaged to the glass pane such that the side rail extends along a respective opposed side of the aperture, the side rails extending past a lower end of the aperture, the panel being slidably engaged to the pair of side rails, such that the side rails are positioned for guiding the panel as the panel is slid between the open configuration and the closed configuration; and a bottom rail engaged to the glass pane such that the bottom rail is parallel to the lower end of the aperture, such that the bottom rail is positioned for seating the panel in the open configuration.

9. The glass integrated fan assembly of claim 1, wherein the second fastener and the first fastener comprise a locking unit, such that the panel can be secured in the closed configuration by an authorized user.

10. The glass integrated fan assembly of claim 9, wherein the locking unit is keyed.

11. The glass integrated fan assembly of claim 1, further including a handle engaged to the panel, wherein the handle is configured for engaging a hand of a user, positioning the user for sliding the panel between the open configuration and the closed configuration.

12. A glass integrated fan assembly comprising:

a door module or window module comprising a frame and a glass pane, the glass pane being engaged to the frame, the frame being configured for positioning in an opening in a structure and for engaging the structure such that the glass pane closes the opening, the glass pane having an aperture positioned therein, the aperture being squarely shaped, the door module comprising a glass door, the glass door being slidably openable and closable;

a fan unit positioned in the aperture and engaged to the glass pane, wherein the fan unit is configured for ventilating an interior space of the structure, the fan unit being rectangularly box shaped, the fan unit comprising:

a power module, the power module comprising a power cord or a battery, a motor operationally engaged to the power module, a plurality of blades engaged to the motor, such that the power module is positioned for selectively powering the motor for turning the blades, and a controller operationally engaged to the power module and the motor, such that the controller is positioned for selectively engaging the motor to the power module for supplying power thereto and for controlling a rotational speed thereof, the controller comprising a receiver;

a remote control operationally engaged to the controller via the receiver, such that the remote control is positioned for selectively signaling the controller for supplying power to the motor and for controlling a rotational speed thereof;

a panel slidably engaged to the glass pane, such that the panel is selectively slidable from an open configuration, wherein the panel is positioned adjacent to the aperture, to a closed configuration, wherein the panel closes the aperture, the panel and the fan unit each being positioned on a respective opposed face of the glass pane;

a pair of side rails, each side rail being engaged to the glass pane such that the side rail extends along a respective opposed side of the aperture, the side rails extending past a lower end of the aperture, the panel being slidably engaged to the pair of side rails, such that the side rails are positioned for guiding the panel as the panel is slid between the open configuration and the closed configuration;

a bottom rail engaged to the glass pane such that the bottom rail is parallel to the lower end of the aperture, such that the bottom rail is positioned for seating the panel in the open configuration;

a first fastener engaged to the panel;

a second fastener engaged to the glass pane, the second fastener being complementary to the first fastener, such that the second fastener is positioned for selectively engaging the first fastener with the panel in the closed configuration, such that the panel is fixedly positioned in the closed configuration, the second fastener and the first fastener comprising a locking unit, such that the panel can be secured in the closed configuration by an authorized user, the locking unit being keyed; and a handle engaged to the panel, wherein the handle is configured for engaging a hand of a user, positioning the user for sliding the panel between the open configuration and the closed configuration.

* * * * *